US010125998B2

(12) United States Patent
Yaman et al.

(10) Patent No.: US 10,125,998 B2
(45) Date of Patent: Nov. 13, 2018

(54) OVEN WHEREOF ELECTRICAL SAFETY IS PROVIDED

(75) Inventors: Yalcin Yaman, Istanbul (TR); Fatih Ceylan, Istanbul (TR); Merih Tarimtoru, Istanbul (TR); Serdar Turkoz, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 1324 days.

(21) Appl. No.: 13/977,716

(22) PCT Filed: Dec. 23, 2011

(86) PCT No.: PCT/EP2011/073994
§ 371 (c)(1),
(2), (4) Date: Oct. 25, 2013

(87) PCT Pub. No.: WO2012/089680
PCT Pub. Date: Jul. 5, 2012

(65) Prior Publication Data

US 2014/0034630 A1 Feb. 6, 2014

(30) Foreign Application Priority Data

Dec. 31, 2010 (TR) ..... a 2010 11258

(51) Int. Cl.
*H05B 1/00* (2006.01)
*F24C 7/08* (2006.01)
(Continued)

(52) U.S. Cl.
CPC ..... *F24C 7/088* (2013.01); *F24C 7/08* (2013.01); *F24C 15/2007* (2013.01); *F24C 15/327* (2013.01)

(58) Field of Classification Search
CPC .. F24C 7/088; F24C 7/08; F24C 7/081; F24C 15/2007; F24C 15/327; F24C 15/001;
(Continued)

(56) References Cited

U.S. PATENT DOCUMENTS 6,354,287 B1 * 3/2002 Kudoh ..... F24C 15/20 126/299 D
2007/0084036 A1 4/2007 Gagne

FOREIGN PATENT DOCUMENTS

CN 1523278 A 8/2004
CN 1576710 A 2/2005
(Continued)

OTHER PUBLICATIONS

International search report and written opinion, dated Jul. 30, 2012, of International Application No. PCT/EP2011/073994; 9 pgs.

*Primary Examiner* — Shawntina Fuqua
(74) *Attorney, Agent, or Firm* — Kilpatrick Townsend & Stockton LLP

(57) ABSTRACT

The oven (1) of the present invention comprises a body (2), at least one oven cavity (3), a casing (4) surrounding the oven cavity (3) and at least one opening (5) disposed on the casing (4) that allows delivery of hot and humid air from the oven (1) to the exterior environment, at least one transmitting member (9, 109) that provides the assembly of the carrier (8) on the body (2), at least one discharge pipe (6, 106), one end connected to the opening (5) and the other end to nipple (7, 107) and starting from the casing (4) maintains the successive contact of the metal surfaces to each other thus providing the flow of electricity by delivering a probable electric leak to the ground for grounding the oven (1).

18 Claims, 3 Drawing Sheets

Figure 1:
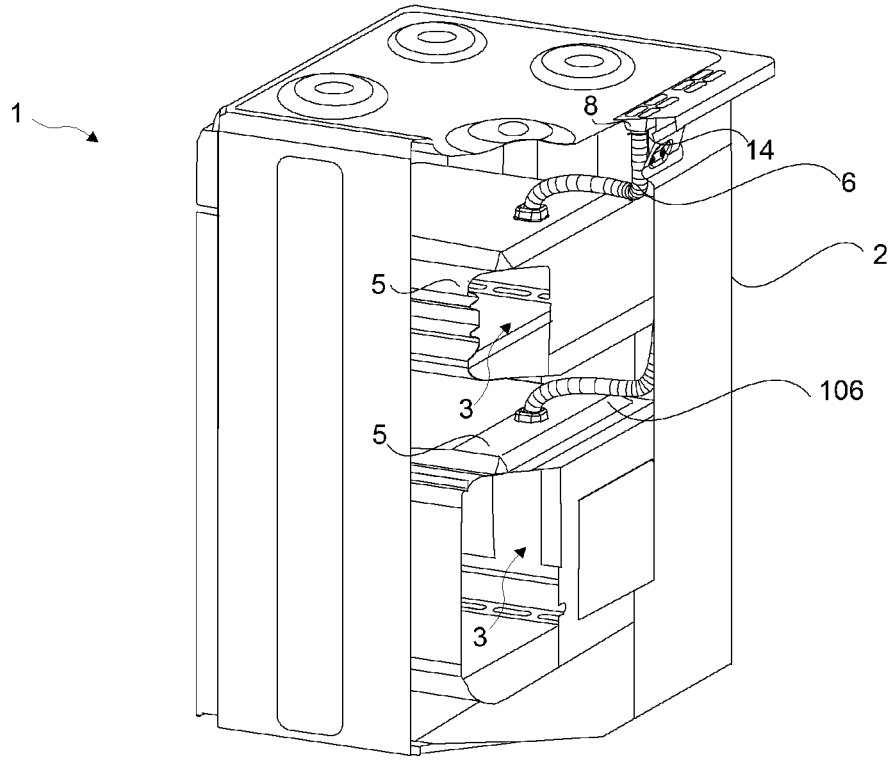

(51) Int. Cl.
*F24C 15/32* (2006.01)
*F24C 15/20* (2006.01)

(58) Field of Classification Search
CPC ..... F24C 15/20; F24C 15/2021; F24C 15/32; F24C 15/325; F24C 15/00; F24C 15/08; F24C 15/16
See application file for complete search history.

(56) References Cited

FOREIGN PATENT DOCUMENTS

| | | | |
|---|---|---|---|
| CN | 2837707 | Y | 11/2006 |
| CN | 201074854 | Y | 6/2008 |
| DE | 3338094 | A1 | 5/1985 |
| DE | 8802657 | U1 | 4/1988 |
| DE | 9301288 | U1 | 10/1993 |
| DE | 10314589 | A1 | 10/2004 |
| DE | 102008011418 | B3 | 7/2009 |
| JP | S5282248 | U | 6/1977 |

* cited by examiner

OVEN WHEREOF ELECTRICAL SAFETY IS PROVIDED

The present invention relates to an oven comprising a grounding element that provides user safety.

Ovens comprise components that function with electricity. The cables that deliver electricity to these components are contained inside the oven and provide the oven to be operated. There would be electric charge on the oven in case of a probable electric leakage due to a cable in the open. In case of an electric leakage, the user is shocked by electricity upon touching the oven cavity for the aim of cleaning, placing foodstuffs etc since the oven cavity is readily accessible by the user. Therefore it is important to discharge the leaked electricity from the metal surfaces in terms of safety.

In the state of the art Chinese Patent Application No. CN1523278A, the grounding element positioned on the rear surface of the cooking chamber and the use of screws for grounding in microwave ovens are described.

In the state of the art Chinese Patent Application No. CN1576710A, an earthing structure for earthing the control panel in microwave ovens and the use of screws for earthing are described.

In the state of the art Chinese Utility Model No. CN201074854Y, the description is given for an grounding device structure like a clamp that is placed onto the power cord in order to ground the microwave oven. In cases wherein screws are used for grounding, since the screw has the risk of sliding, it is disclosed that by using the clamp this risk is prevented.

The aim of the present invention is the realization of an oven wherein electrical safety is provided thereby maintaining user safety.

The electrical safety provided oven realized in order to attain the aim of the present invention, explicated in the first claim and the respective claims thereof, comprises at least one opening disposed on the casing that surrounds the oven cavity.

The oven comprises at least one discharge pipe with one end connected to the opening, providing the hot and humid air to be discharged to the exterior environment, at least one carrier mounted on the body, whereto one end of the discharge pipe is connected and at least one transmitting member providing the carrier to be mounted on the body. A metal screw or a housing formed from metal material all around wherein the screw is fitted is used as the transmitting member. The transmitting member is metal.

The oven is grounded in order to prevent a probable electric leak that may occur in one of the cables delivering electricity to the components inside the oven that are connected to electricity and operate with electricity. Therefore, electricity should be delivered to the ground by flowing through the metal surfaces.

The oven comprises at least one resilient element, one end surrounding the discharge pipe by contacting the discharge pipe, the other end fastened on the carrier so as to contact the transmitting member. The resilient member produced from metal material and formed by shaping a metal wire, provides electricity to flow and to be grounded by connecting the discharge pipe and the body to each other, maintaining connection between the metal surfaces for grounding electricity by means of the transmitting members. The resilient element is disposed so as to contact the surface of the transmitting member located on the carrier.

The resilient element prevents dislodging of the discharge pipe from the carrier by surrounding the discharge pipe from the exterior with its end contacting the discharge pipe and secures the discharge pipe to the carrier. The end of the resilient element at least partially surrounding the discharge pipe makes a bend by means of the elastic structure of the resilient element that allows bending. The resilient element surrounds the discharge pipe when an approximately half-moon shaped bend is made that functions as the clamp.

In case of a probable electrical leak, flow of electricity to the ground is maintained to be continuous by squeezing in the resilient element between the carrier and the body. In addition to this, the resilient element is provided to contact the metal surfaces of the transmitting member on the carrier.

In an embodiment of the present invention, at least two detent means are placed on the carrier that eliminates the problem of the resilient element moving from its secured place and not being able to contact the transmitting member. The detent means are positioned so as to be opposite to each other and forming a barrier by being one over the other. The resilient element is squeezed in between these detent means that are placed opposite and positioned diagonally with respect to each other.

In a derivative of this embodiment of the present invention, the resilient element, shaped so as to contact the discharge pipe and the transmitting member, supported with at least two detent means and secured by being positioned and squeezed in between the detent means, is formed by bending a metal wire with elastic features. The resilient element makes bends as much as the number of transmitting members.

In an embodiment of the present invention, the oven comprises two discharge pipes. The resilient element has two separate clamps that function as pincers for at least partially surrounding the discharge pipes. The clamps make almost circular shaped bends from two ends of the resilient element so as to surround the discharge pipe. The discharge pipe (6, 106) is prevented from dislodging. The resilient element has two arms that extend from one end of the clamps, almost vertically to the plane whereon the clamps are located. The arms extend almost vertically to the clamps, approximately from the level of the discharge pipes in the vertical direction. The arms extend towards the transmitting member by being disposed between the detent means.

The resilient element is bent so as to contact the metal surface of the transmitting member located on the carrier and takes almost U shape. The resilient element makes bends as much as the number of transmitting members. The resilient element, disposed between the detent means, comprises a connecting rod that maintains continuous contact of the metal surfaces extending along the plane whereon the transmitting member joining the arms is disposed on the carrier. Thus, the resilient element provides flow of electricity by connecting all metal surfaces to each other by means of the clamp, the connecting rod and the arms. In an embodiment of the present invention, the carrier has at least one hollow nipple extending towards into the body, whereto one end of the discharge pipe is connected.

In a derivative of this embodiment, the carrier has the nipple with serrated external surface. The nipple providing the discharge pipe to be more firmly connected to the carrier by means of its serrated surface eliminates undesired situations like the discharge pipe sliding or dislodging for some reason.

In an embodiment of the present invention, the transmitting member is a screw.

In an embodiment of the present invention, the transmitting member is in the form of a metal insert produced from metal material and integrated on the carrier.

In an embodiment of the present invention, the carrier is produced from plastic material. This is a more advantageous embodiment in terms of production costs.

The electrical safety provided oven, realized in order to attain the aim of the present invention is illustrated in the attached figures, where:

FIG. 1—is the rear partial cross-section perspective view of the oven.

Figure 2:
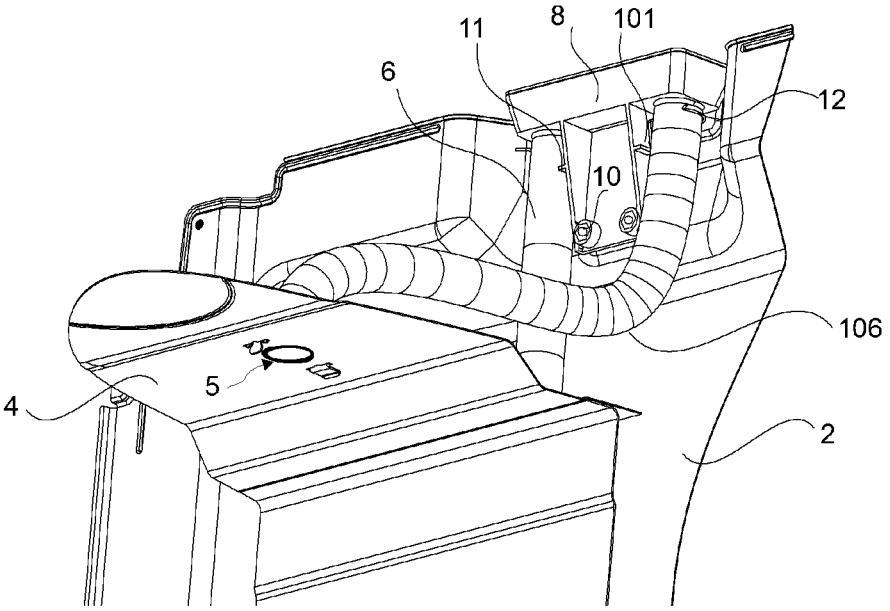

FIG. 2—is the perspective view of a discharge pipe, a carrier and a casing.

Figure 3:
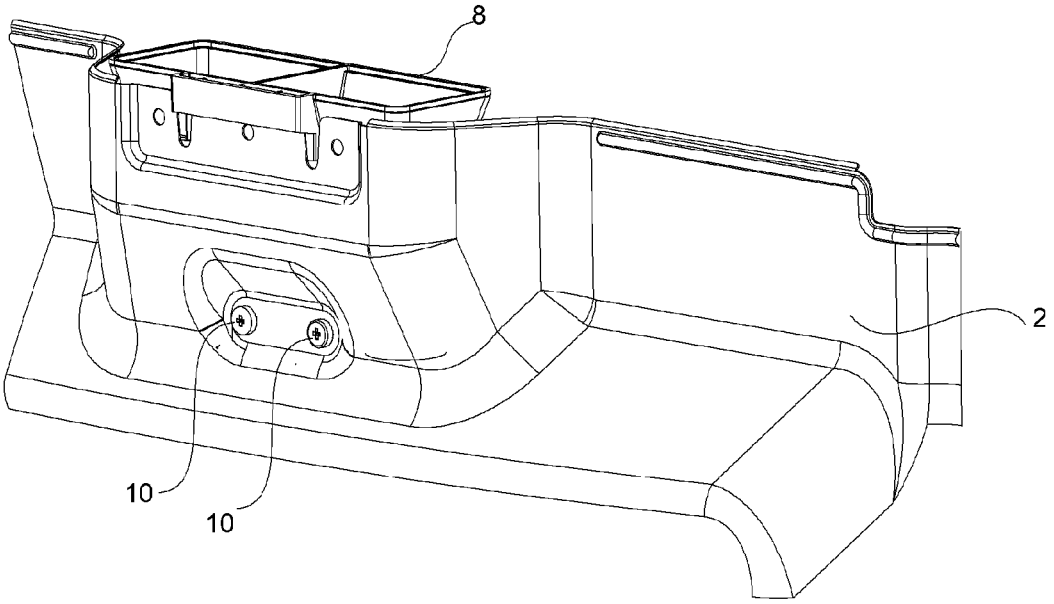

FIG. 3—is the perspective view of a body with the carrier located thereon.

Figure 4:
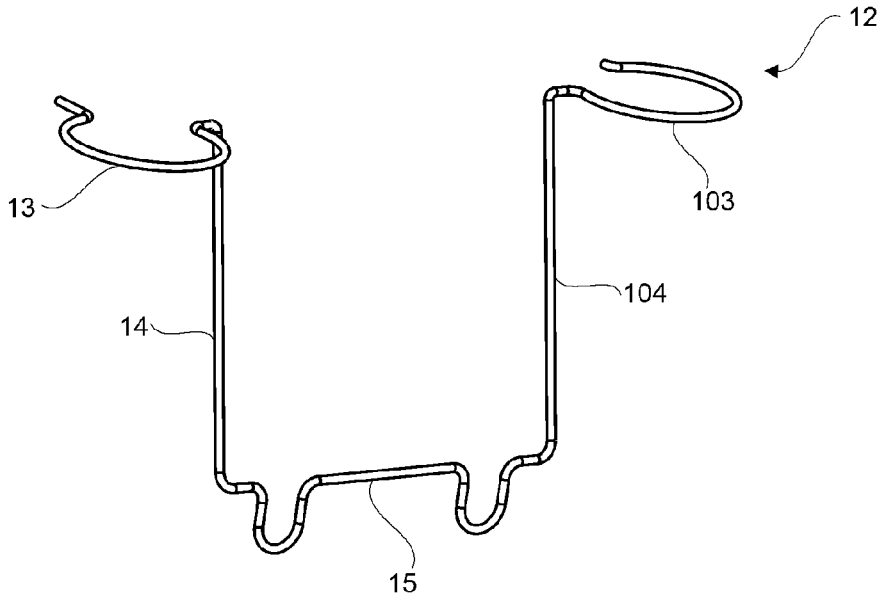

FIG. 4—is the perspective view of the resilient element.

Figure 5:
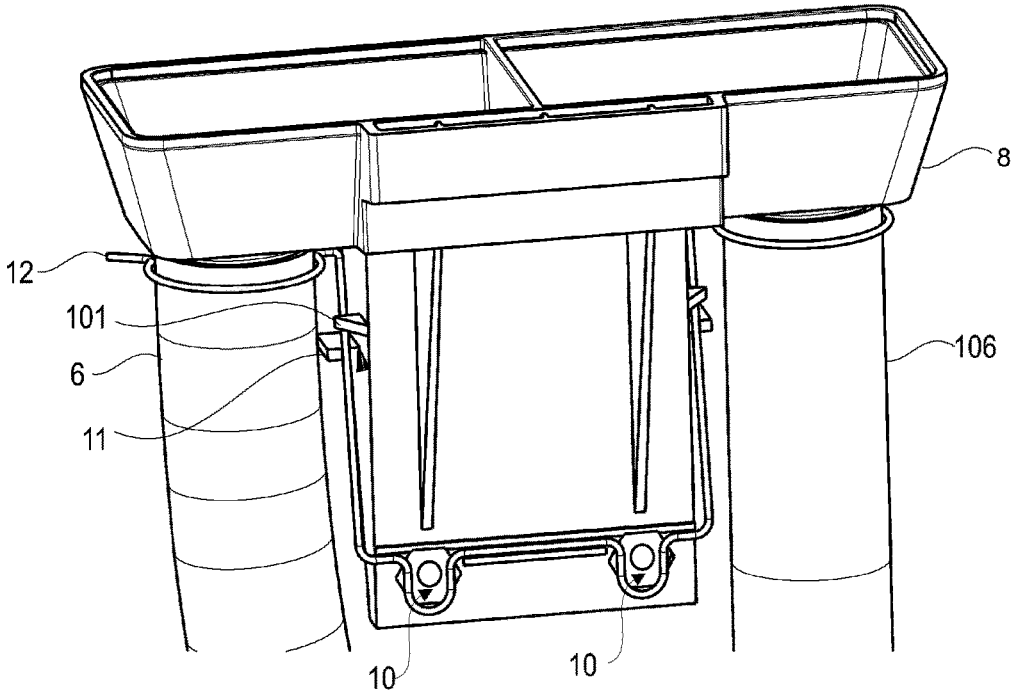

FIG. 5—is the perspective view of a carrier whereon a discharge pipe is connected thereon with a resilient element.

Figure 6:
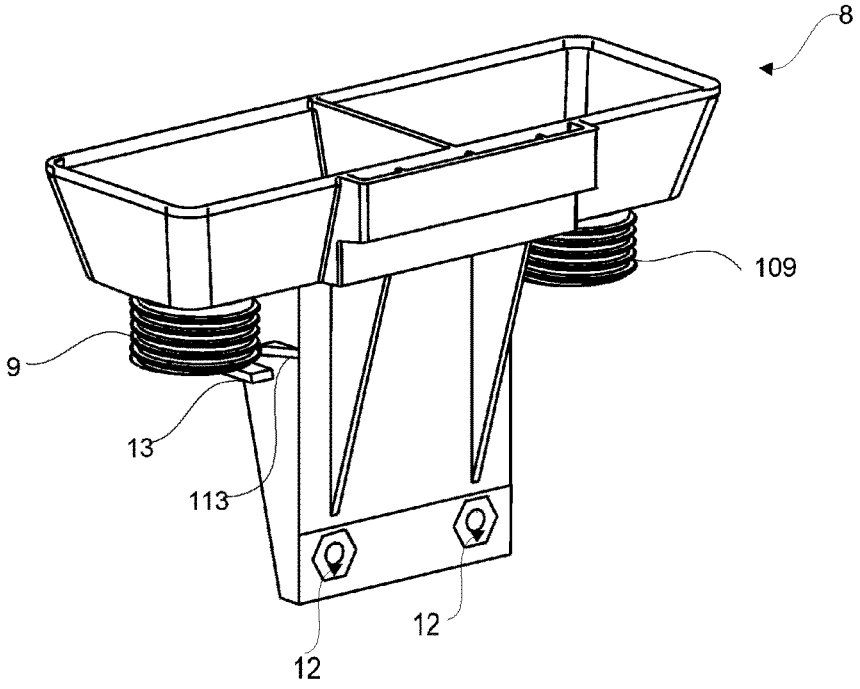

FIG. 6—is the perspective view of a carrier.

The elements illustrated in the figures are numbered as follows:

1. Oven
2. Body
3. Oven cavity
4. Casing
5. Opening
6., 106. Discharge pipe
7., 107. Nipple
8. Carrier
9., 109. Transmitting member
10. Connecting rod
11., 101. Detent means
12. Resilient element
12., 103. Clamp
14., 104. Arm The oven (1) comprises a body (2), at least one oven cavity (3) disposed inside the body (2), a casing (4) surrounding the oven cavity (3) and at least one opening (5) disposed on the casing (4) (FIG. 1).

The oven (1) comprises at least one discharge pipe (6, 106), providing the hot and humid air to be delivered to the exterior environment, one end connected to the opening (5) and at least one carrier (8) mounted on the body (2) whereto the other end of the discharge pipe (6, 106) is connected (FIG. 2). Thus, the hot and humid air inside the oven cavity (3) is delivered to the exterior environment by leaving the opening (5) and passing through the discharge pipe (6, 106) and the carrier (8) (FIG. 1 and FIG. 2).

The oven (1) comprises at least one transmitting member (9, 109) that provides the assembly of the carrier (8) on the body (2). A metal screw or a housing formed from metal material all around wherein the screw is fitted is used as the transmitting member (9, 109). The transmitting member (9, 109) transmits the electric current to metal surfaces.

The oven (1) comprises at least one resilient element (12), produced from metal material, one end surrounding the discharge pipe (6, 106) by contacting the discharge pipe (6, 106), the other end fastened on the carrier (8) so as to contact the transmitting member (9, 109), providing the grounding of electricity by connecting the discharge pipe (6, 106) and the body (2) to each other, maintaining the connection between the metal surfaces by means of the transmitting member (9, 109). The resilient element (12) of the present invention is formed by shaping a metal wire having resilient features (FIG. 4). The resilient element (12) is placed so as to contact the metal surface of the transmitting member (9, 109) on the carrier (8).

The end of the resilient element (12) contacting the discharge pipe (6, 106) prevents dislodging of the discharge pipe (6, 106) from the carrier (8) by surrounding the discharge pipe (6, 106). The resilient element (12) surrounds at least partially the discharge pipe (6, 106) so as to form almost circular shape externally, such that the discharge pipe (6, 106) is seated on one end of the elastic metal wire, and forms a housing for the discharge pipe (6, 106). Surrounding of the discharge pipe (6, 106) by the resilient element (12) provides securing of the discharge pipe (6, 106) after being fitted on the carrier (8).

The resilient element (12) is disposed between the carrier (8) and the body (2). The resilient element (12) of elastic structure does not entirely contact the body (2) surface and the metal surfaces of the transmitting member (9, 109) on the carrier (8) due to its elastic structure when disposed in a position to surround the discharge pipe (6, 106). The resilient element (12) must be squeezed in between the carrier (8) and the body (2) in order to provide contact of the metal surfaces. Thus, the probable electric leak is delivered from the metal surfaces contacting each other to the ground.

In an embodiment of the present invention, the oven (1) comprises at least two detent means (11, 101) disposed on the carrier (8) that provide securing of the resilient element (12) (FIG. 5 and FIG. 6). Thus, the problem of not being able to contact the transmitting members (9, 109) in case the resilient element (12) cannot be secured is eliminated. The resilient element (12) configured by bending an elastic metal wire, is provided to contact the transmitting member (9, 109) and the discharge pipe (6, 106) by being supported with the detent means (11, 101). In the case of a probable electric leak, the electric current flowing towards the discharge pipe (6, 106) from the surface of the metal casing (4) and/or by one or several live ends of the electric cables contacting the discharge pipe (6, 106) is delivered to the body (2) by passing through the transmitting member (9, 109) which is metal, by means of the resilient element (12). Thus, grounding is realized.

In a derivative of this embodiment of the present invention, the oven (1) comprises two detent means (11, 101) that are positioned one over the other so as to face each other oppositely. The resilient element (12), contacted with the discharge pipe (6, 106) and the transmitting members (9, 109) is positioned by being squeezed with the detent means (11, 101). Thus, the resilient element (12) is secured and grounding is realized.

In an embodiment of the present invention, the oven (1) comprises two discharge pipes (6, 106). The resilient element (12) has two separate clamps (13, 103) that take the shape of almost a circle for surrounding the discharge pipes (6, 106). The clamps (13, 103) are disposed in the horizontal plane and provide securing of the discharge pipe (6, 106) to the carrier (8) by surrounding it and prevent the discharge pipe (6, 106) from dislodging. The clamps (13, 103) at least partially surround the cross-section of the discharge pipe (6, 106). The resilient element (12) has two arms (14, 104) that extend from one end of the clamps (13, 103) almost vertically to the plane wherein the clamps (13, 103) are located and a connecting rod (10) maintains continuous contact of the metal surfaces that extends along the plane where the transmitting member (9, 109) joining the arms (14, 104) is disposed on the carrier (8). The arms (14, 104) extend towards the transmitting member (9, 109), approximately from the level of the discharge pipes (6, 106), almost vertically to the clamps (13, 103) and in the direction to be placed in between the detent means (11, 101) (FIG. 4). The resilient element (12) takes almost U shape in the portion of the transmitting member (9, 109) situated on the carrier (8). The resilient element (12) is bent so as to contact the metal surface of the transmitting member (9, 109) on the carrier (8)

and makes bends as much as the number of transmitting members (9, 109). The probable leaks on the oven (1) are prevented by grounding by means of this shape of the resilient element (12).

In an embodiment of the present invention, the carrier (8) comprises at least one hollow nipple (7, 107) that extends towards into the body (2). One end of the discharge pipe (6, 106) is connected to the carrier (8) by being mounted to the nipple (7, 107). The nipple (7, 107) provides securing of the discharge pipe (6, 106) since it is placed on the interior surface of the discharge pipe (6, 106). Thus, the discharge pipe (6, 106) is secured and electricity is provided to be delivered to the ground by flowing through the resilient element (12).

In a derivative of this embodiment of the present invention, the surface of the nipple (7, 107) where the discharge pipe (6, 106) is disposed and whereto one end of the discharge pipe (6, 106) is connected, is serrated. The serrated surface provides the discharge pipe (6, 106) to be attached. The nipple (7, 107) provides the discharge pipe (6, 106) to be connected more firmly by means of this surface.

In an embodiment of the present invention, the transmitting member (9, 109) is a screw. The carrier (8) is mounted on the body (2) by means of the screw (9,109). The resilient element (12) is disposed so as to contact the surface of the housing (10) wherein the screw (9, 109) is positioned on the carrier (8) and makes bends so as to surround the surface of the screw (9, 109) on the carrier (8). The resilient element (12) is shaped so as to increase the metal surface contact. The resilient element (12) makes bends as much as the number of screws (9, 109). The reason for this is to provide continuity of the metal-metal connection. Accordingly, in case of a probable electric leak, electricity flow is made continuous with the metal-metal connection in the flow path of electricity to the ground and grounding is provided.

In an embodiment of the present invention, the transmitting member (9, 109) is in the form of a metal insert produced from metal material and integrated on the carrier (8). A housing, produced from metal material, is disposed on the transmitting member (9, 109) wherein the metal parts are seated that provide connecting of the carrier (8) to the body (2). Thus, the metal surfaces are connected to each other and realize grounding.

In an embodiment of the present invention, the carrier (8) is produced from plastic material. In producing the carrier (8) from plastic material, the molding process is made more easily as compared with metal materials. Thus, cost advantage is provided.

By means of the present invention, grounding in the oven (1) is made by means of the resilient element (12) for protecting the user from probable electric leaks. The resilient element (12) which is metal, connects the metal surfaces to each other and electricity on the oven (1) is provided to be discharged by delivering probable electric leaks from the metal surfaces to the body (2). Consequently, an oven (1) with high safety standards is realized and the user is protected from a probable electric leak upon contacting the oven cavity (3), which is easily accessible by the user, for the aims of cleaning, placing foodstuffs etc.

It is to be understood that the present invention is not limited to the embodiments disclosed above and a person skilled in the art can easily introduce different embodiments. These should be considered within the scope of the protection postulated by the claims of the present invention.

The invention claimed is:

1. An oven (1) comprising a body (2), at least one oven cavity (3) disposed inside the body (2), a casing (4) surrounding the oven cavity (3), at least one opening (5) located on the casing (4), at least one carrier (8) disposed on the body (2), at least one transmitting member (9, 109) that provides assembly of the carrier (8) on the body (2), at least one discharge pipe (6, 106), one end connected to the opening (5) and other end to the carrier (8), at least one resilient element (12) surrounding the discharge pipe (6, 106) with one end contacting the discharge pipe (6, 106) and the other end fastened on the carrier (8) so as to contact the transmitting member (9, 109), wherein the at least one resilient element is produced from metal material and provides grounding of electricity by connecting the discharge pipe (6, 106) and the body (2) to each other, and by maintaining the connection between metal surfaces by means of the transmitting member (9, 109), wherein the at least one resilient element (12) is disposed between the carrier (8) and the body (2).

2. The oven (1) as in claim 1, wherein the at least one transmitting member (9, 109) is produced from metal material, and includes a screw or a housing wherein the screw is disposed.

3. The oven (1) as in claim 2, wherein the resilient element (12) prevents dislodging of the discharge pipe (6, 106) from the carrier (8) and secures the discharge pipe (6, 106) to the carrier (8) by its end that contacts the discharge pipe (6, 106) by externally surrounding the discharge pipe (6, 106).

4. The oven (1) as in claim 3, further comprising at least two detent means (11, 101) disposed on the carrier (8) that prevent movement of the resilient element (12) from its secured location.

5. The oven (1) as in claim 4, wherein the at least two detent means (11, 101) positioned on the carrier (8) one over the other, so as to face each other oppositely, prevent movement of the resilient element (12) from its secured location.

6. The oven (1) as in claim 5, wherein the at least one resilient element (12) is disposed so as to contact the metal surface of the transmitting member (9, 109) on the carrier (8).

7. The oven (1) as in claim 1, wherein the at least one resilient element (12), made by bending a metal wire with elastic features, is shaped so as to contact the discharge pipe (6, 106) and the transmitting member (9, 109), is supported by two detent means (11, 101) and positioned by being squeezed in between the detent means (11, 101).

8. The oven (1) as in claim 1, wherein the at least one resilient element (12) has two clamps (13, 103) of almost circular shape that at least partially surround the discharge pipes (6, 106).

9. The oven (1) as in claim 1, wherein the at least one resilient element (12) is bent so as to contact the metal surface of the transmitting member (9, 109) on the carrier (8) and includes bends as much as the number of the transmitting members (9, 109).

10. The oven (1) as in claim 8, wherein the at least one resilient element (12) has two arms (4, 104) that extend from one end of the clamps (13, 103) almost vertically to the plane where the clamps (13, 103) are located.

11. The oven (1) as in claim 10, wherein the at least one resilient element (12), has a connecting rod (10) that joins the arms (14, 104) and extend along the plane where the transmitting member (9, 109) is disposed on the carrier (8).

12. The oven (1) as in claim 8, wherein the at least one resilient element (12) has arms (14, 104) that extend approximately from the level of the discharge pipes (6, 106) almost vertically to the clamps (13, 103), towards the transmitting member (9, 109) and in the direction to be placed in between the detent means (11, 101).

13. The oven (1) as in claim 1, wherein the carrier (8) has at least one hollow nipple (7, 107) that extends towards into the body (2) and whereto one end of the discharge pipe (6, 106) is connected.

14. The oven (1) as in claim 1, wherein the transmitting member (9, 109) is integrated on the carrier (8) in the form of an insert, and is produced from metal material.

15. The oven (1) as in claim 1, wherein the resilient element (12) prevents dislodging of the discharge pipe (6, 106) from the carrier (8) and secures the discharge pipe (6, 106) to the carrier (8) by its end that contacts the discharge pipe (6, 106) externally surrounding the discharge pipe (6, 106).

16. The oven (1) as in claim 1, further comprising at least two detent means (11, 101) disposed on the carrier (8) that prevent movement of the resilient element (12) from its secured location.

17. The oven (1) as in claim 16, wherein the at least two detent means (11, 101) positioned on the carrier (8) one over the other, so as to face each other oppositely, prevent movement of the resilient element (12) from its secured location.

18. The oven (1) as in claim 1, further comprising least two detent means (11, 101) positioned on the carrier (8) one over the other, so as to face each other oppositely, and that prevent movement of the resilient element (12) from its secured location.

* * * * *